US008631758B2

(12) United States Patent
Pei

(10) Patent No.: US 8,631,758 B2
(45) **Date of Patent: *Jan. 21, 2014**

(54) DRUM COATING DEVICE

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 669 days.

This patent is subject to a terminal disclaimer.

(21) Appl. No.: 12/916,619

(22) Filed: Oct. 31, 2010

(65) Prior Publication Data

US 2012/0012051 A1 Jan. 19, 2012

(30) Foreign Application Priority Data

Jul. 14, 2010 (TW) ..... 99123057 A

(51) Int. Cl.

| | |
|---|---|
| ***B05C 13/02*** | (2006.01) |
| ***B05C 11/00*** | (2006.01) |
| ***B05C 5/00*** | (2006.01) |
| ***B05B 7/06*** | (2006.01) |
| ***C23C 14/00*** | (2006.01) |

(52) U.S. Cl.

USPC ..... 118/66; 118/300; 118/50; 118/326; 118/500; 118/503; 118/58; 118/692; 118/715; 118/313

(58) Field of Classification Search

USPC ..... 118/50, 326, 300, 313–315, 715, 716, 118/734, 500, 503, 58, 59, 66, 692, 663, 118/695, 698, 101–110, 304; 204/192.11–192.15

See application file for complete search history.

(56) References Cited

U.S. PATENT DOCUMENTS

| | | | | |
|---|---|---|---|---|
| 5,038,707 | A * | 8/1991 | Swain et al. | 118/58 |
| 8,316,791 | B2 * | 11/2012 | Pei | 118/66 |
| 2004/0020601 | A1 * | 2/2004 | Zhao et al. | 156/345.32 |
| 2005/0040349 | A1 * | 2/2005 | Kum et al. | 250/559.29 |
| 2008/0220621 | A1 * | 9/2008 | Shinozaki et al. | 438/795 |

* cited by examiner

*Primary Examiner* — Yewebdar Tadesse

(74) *Attorney, Agent, or Firm* — Altis Law Group, Inc.

(57) ABSTRACT

A drum coating device for coating work-pieces includes a main body, a support element, a cleaning device, a spraying device, a rotary drum device, a heating device, and a drive device. The main body defines a receiving room. The support element is received in the receiving room and defines slots for receiving the work-pieces. The cleaning device cleans the work-pieces. The spraying device sprays coating materials to the work-pieces. The rotary drum device uniformly coats the coating materials on the work-pieces. The heating device heats the coating materials coated on the work-pieces. The drive device includes a rotating drive rotating the support element and a linear drive raising or lowering the support element in the receiving room.

13 Claims, 5 Drawing Sheets

DRUM COATING DEVICE

BACKGROUND

1. Technical Field

The present disclosure relates to coating technologies and, particularly, to a drum coating device.

2. Description of Related Art

Coatings are films or multi-films that are applied to surfaces of work-pieces by various physical or chemical methods. A current coating process includes the following steps: cleaning the work-pieces, spraying coating materials on the work-pieces, uniformize the coating materials, and heating the work-pieces. The steps need to be performed in different devices, and therefore the work-pieces need to be transported among the different devices and may be contaminated during transportation.

Therefore, it is desirable to provide a drum coating device which can overcome the limitations described above.

DETAILED DESCRIPTION

Embodiments of the disclosure will now be described in detail, with reference to the accompanying drawings.

Figure 1:
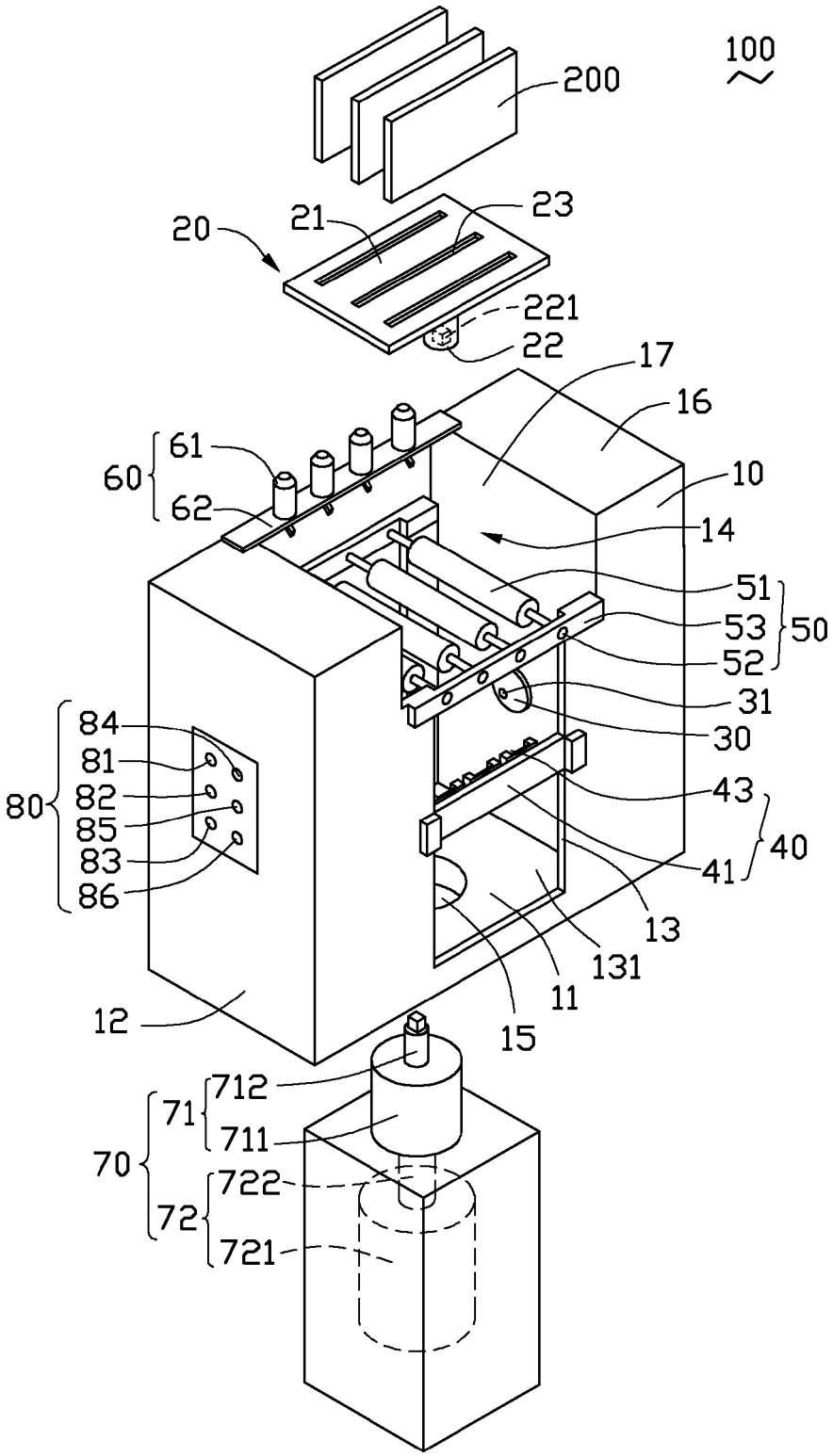
FIG. 1 is an isometric, exploded view of a drum coating device, according to an exemplary embodiment.
Figure 2:
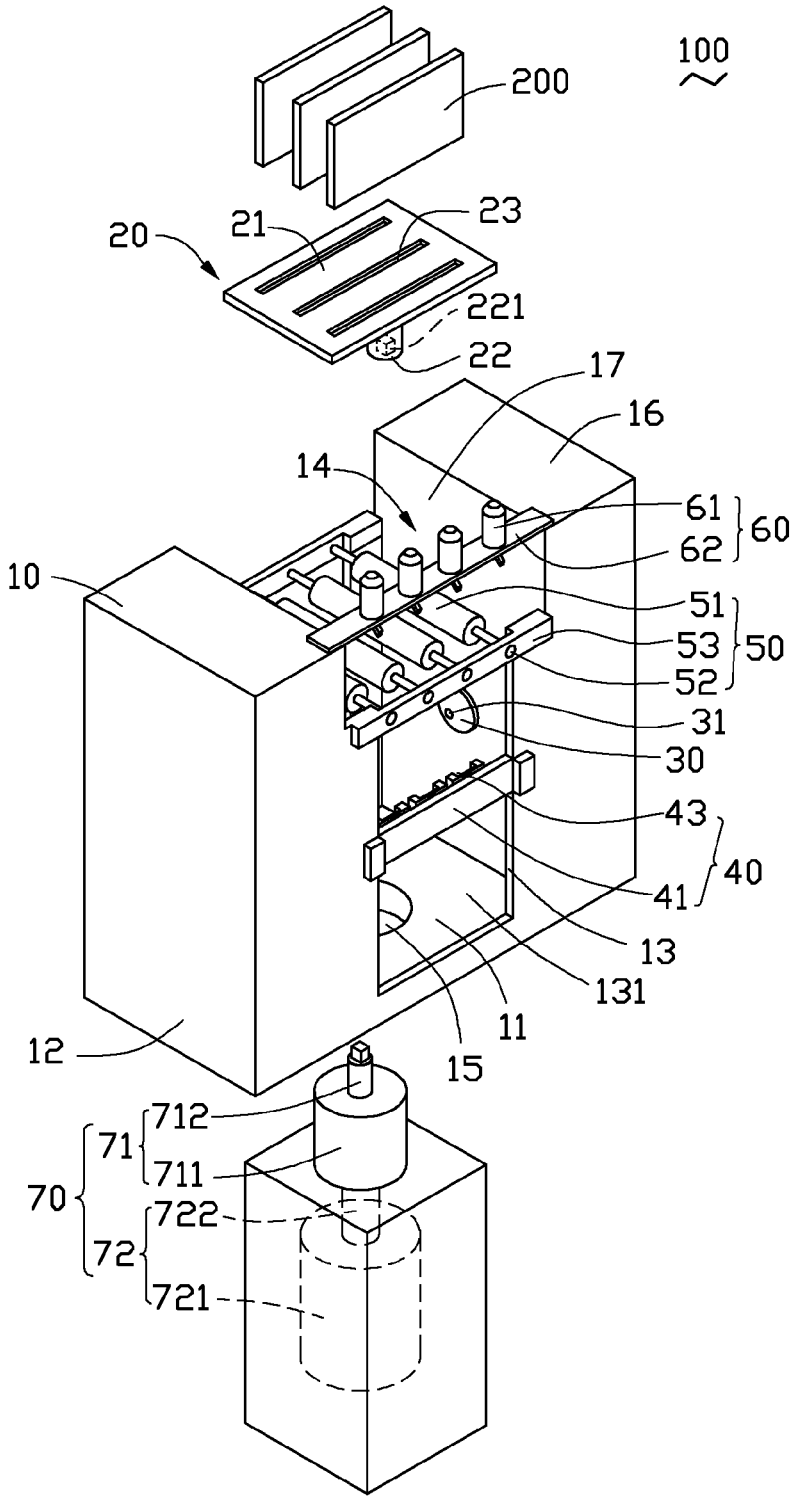
FIG. 2 is similar to FIG. 1, but viewed from another angle.

Referring to FIGS. 1-2, a drum coating device 100, according to an exemplary embodiment, is provided to coat a film on work-pieces 200. The drum coating device 100 includes a main body 10, a support element 20, a cleaning device 30, two heating devices 40, a rotary drum device 50, a spraying device 60, a drive device 70, and a control device 80. In this embodiment, the work-pieces 200 are made of glass.

The main body 10 includes a bottom plate 11, two side plates 12, and two shielding plates 13. The two side plates 12 perpendicularly extend upwards from two opposite edges of the bottom plate 11. The two shielding plates 13 are respectively perpendicularly interconnected the side of the bottom plate 11 and the side plates 12. The bottom plate 11, the two side plates 12, and the two shielding plates 13 form a receiving room 14. The shielding plates 13 are lower than the side plates 12. Each of the two shielding plates 13 defines a notch 131 linking the receiving room 14 with the outside. The bottom plate 11 defines a through hole 15 generally at the center thereof. Each of the side plates 12 includes an upper surface 16 and a side surface 17. The two side surfaces 17 of the side plates 12 oppose each other.

The support element 20 includes a support plate 21 and a connection pole 22 extending downward from a bottom surface of the support plate 21, generally at the center thereof. The support plate 21 defines a number of slots 23 on a surface away from the connection pole 22. The slots 23 receive the work-pieces 200. The slots 23 are equidistantly arranged and all extend along a direction substantially parallel to the lengthwise direction of the support plate 21. The connection pole 22 defines a receiving hole 221 in an end surface away from the support plate 21, generally at the center thereof. The receiving hole 221 is a rectangular configuration.

The cleaning device 30 includes two cleaning nozzles 31. The two cleaning nozzles 31 are oppositely arranged and are located generally at the middle of the two side surfaces 17. The cleaning nozzles 31 link to an air source (not shown). The cleaning nozzles 31 can be connected to the side surfaces 17 by various connection technologies such as glue or magnetic attraction.

Each of the heating devices 40 is fixed on the shielding plates 13. The extending direction of the heating devices 40 is substantially perpendicular to the side plates 12. The heating device 40 includes a circuit board 41 and a number of heating elements 43 electrically connected to the circuit board 41. The circuit board 41 is bridged between two sides of each notch 131, generally at the middle of the notches 131. The heating elements 43 oppose the receiving room 14. The circuit board 41 controls the connection and disconnection between the heating elements 43 and a power source for powering the heating elements 43, and adjusting the heating temperature of the heating elements 43.

The rotary drum device 50 includes a number of rollers 51, a number of rolling drivers 52, and two first support strips 53. The rotary drum device 50 is positioned above the cleaning device 30. The two first support strips 53 are oppositely positioned at one end of each shielding plate 13 adjacent to the upper surfaces 16 of the side plates 12. The rollers 51 are equidistantly spaced and are rotatably bridged the two first support strips 53. The distance between each two adjacent rollers 51 is substantially equal to or slightly larger a thickness of the work-pieces 200. The rolling drivers 52 are secured to the first support strips 53, and are coupled with a corresponding end of the rollers 51. The rolling drivers 52 drive the rollers 51 to rotate.

The spraying device 60 includes a number of spraying nozzles 61 and a second support strip 62. The second support strip 62 bridges the two upper surfaces 16, at a side of the two upper surfaces 16. The spraying nozzles 61 are fixed on the second support strip 62 and communicate with a coating material source (not shown). The spraying nozzles 61 oppose the bottom plate 11 and spray the coating materials to the work-pieces 200.

The drive device 70 includes a rotating drive 71 and a linear drive 72. The rotating drive 71 includes a rotating stator 711 and a rotating rotor 712 extending from the rotating stator 711. The diameter of the receiving hole 221 is slightly greater than the diameter of the rotating rotor 712. The end of the rotating rotor 712 away from the rotating stator 711 is a rectangular configuration. The linear drive 72 includes a linear stator 721 and a linear moving element 722 extending upward from the linear stator 721. The linear moving element 722 is in direct line with and coupled with the rotating stator 711.

The control device 80 includes a number of function switches, such as a first switch 81 controlling the rotating drive 71. A second switch 82 controlling the linear drive 72. A third switch 83 controlling the cleaning device 30. A fourth switch 84 controlling the heating device 40. A fifth switch 85 controlling the rotary drum device 50. A sixth switch 86 controlling the spraying device 60.

In assembly, one side of each work-piece 200 is received in a respective one of the slots 23 of the support plate 21. The support element 20 supporting the work-pieces 200 is placed into the receiving room 14 through the notches 131. The rotor 712 is inserted into the receiving room 14 through the through hole 15. One end of the rotor 712 is sleeved in the receiving groove 221 of the connection pole 22.

Figure 3:
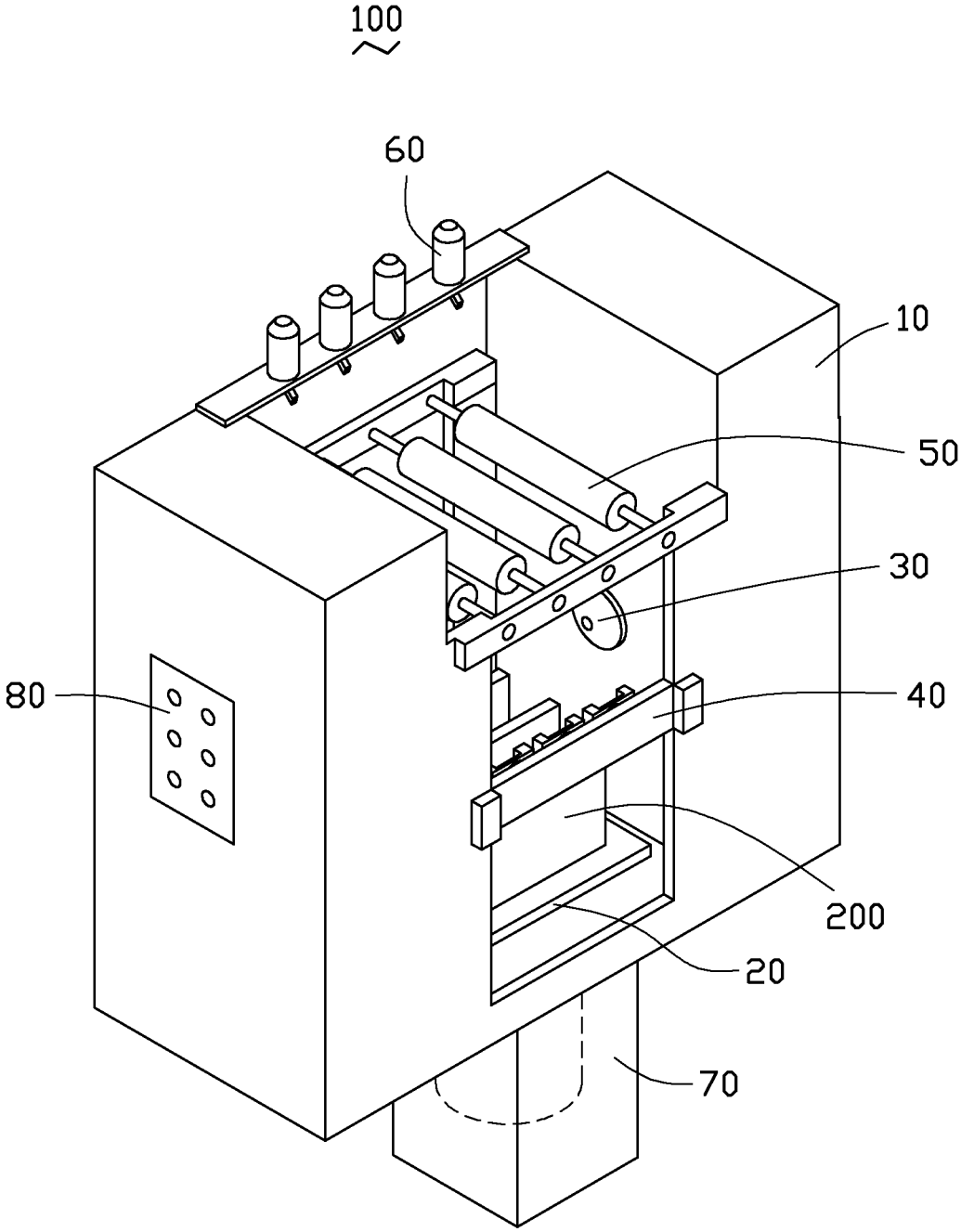
FIG. 3 is an isometric view of the drum coating device of FIG. 1, which is in a first working state.

Referring to FIG. 3, in a first state (i.e., a sub-process) of the coating process, the work-pieces 200 are lifted to align with the cleaning device 30 with the linear drive 72. Then, the rotating drive 71 rotates the work-pieces 200 to oppose the cleaning device 30, the cleaning device 30 is turned on to clean the work-pieces 200.

Figure 4:
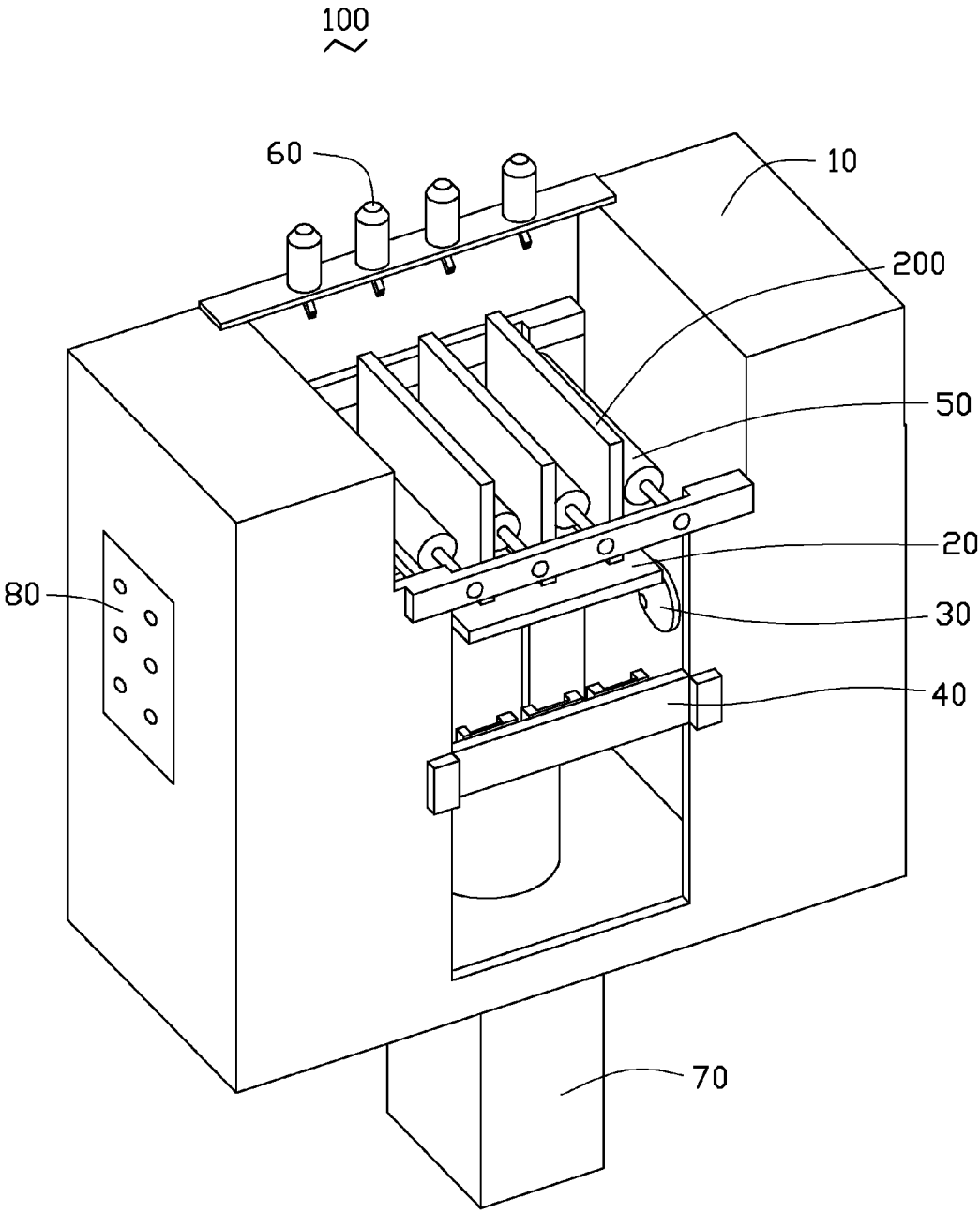
FIG. 4 is an isometric view of the drum coating device of FIG. 1, which is in a second working state.

Referring to FIG. 4, in a second state of the coating process, after the work-pieces 200 are cleaned, the control device 80 turns off the cleaning device 30. The rotating drive 71 rotates the work-pieces 200 to be substantially parallel with the extending direction of the rollers 51 until the work-pieces 200 are aligned with gaps of the rollers 51. The work-pieces 200 are lifted to be received in the gaps of the rollers 51 with the linear drive 72. The rolling drivers 52 rotate the rollers 51 and the spraying device 60 is turned on to spray out coating materials on the work-pieces 200. In the process of rolling of the rollers 51, the coating materials are uniformly coated on the work-pieces 200.

Figure 5:
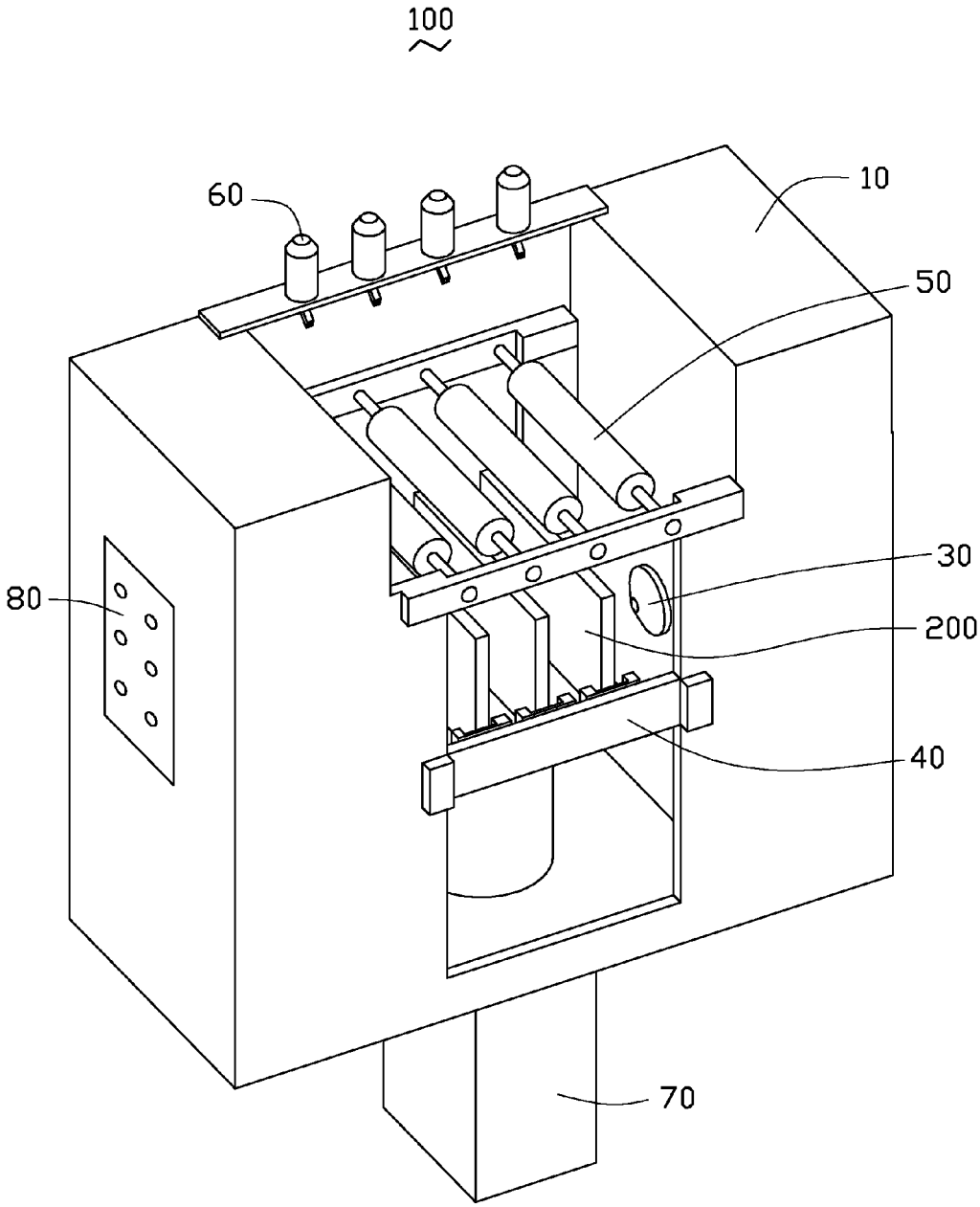
FIG. 5 is an isometric view of the drum coating device of FIG. 1, which is in a third working state.

Referring to FIG. 5, in a third state of the coating process, the work-pieces 200 are drawn to the middle of the first receiving room 11. The work-pieces 200 remain substantially parallel with the extending direction of the rollers 51. The heating device 40 is turned on to heat the coating materials coated on the work-pieces 200. When a crystal of the coating materials is formed on the work-pieces 200, a film coated on the work-pieces 200 is obtained.

The present disclosure provides a drum coating device assembly, a cleaning device, and a heating device. The work-pieces can be coated with a film in one drum coating device, and do not need to be transferred from one place to another place, which avoids the work-pieces from being contaminated.

Particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A drum coating device for coating a plurality of work-pieces, comprising:

a main body defining a receiving room;

a support element received in the receiving room, and defining a plurality of slots for receiving the work-pieces;

a cleaning device positioned on the main body and opposing the receiving room, the cleaning device configured for cleaning the work-pieces;

a spraying device positioned on the top of the main body and configured for spraying coating materials to the work-pieces;

a rotary drum device received in the receiving room and positioned above the cleaning device and below the spraying device, the rotary drum configured for uniformly coating the coating materials on the work-pieces;

a heating device positioned on the main body and opposing the receiving room, the heating device configured for heating the coating materials coated on the work-pieces;

a drive device positioned on the bottom of the main body and comprising a rotating drive configured for rotating the support element and a linear drive configured for raising or lowering the support element in the receiving room.

2. The drum coating device of claim 1, further comprising a control device configured for controlling the cleaning device, the spraying device, the rotary drum device, the heating device, and the drive device.

3. The drum coating device of claim 1, wherein the support element comprises a support plate and a connection pole extending downward from a bottom surface of the support plate, the connection pole defines a receiving groove in an end away from the support plate.

4. The drum coating device of claim 3, wherein the rotating drive comprises a rotating stator and a rotating rotor, the diameter of the receiving groove is slightly greater than the diameter of the rotating rotor, one end of the rotating rotor away from the rotating stator is sleeved in the receiving groove.

5. The drum coating device of claim 4, wherein the linear drive comprises a linear stator and a linear moving element extending upward from one terminal of the linear stator, the linear moving element is in direct line with and coupled with the rotating stator.

6. The drum coating device of claim 5, wherein the receiving groove is a rectangular configuration, and the end of the rotating rotor away from the rotating stator is a rectangular configuration.

7. The drum coating device of claim 1, wherein the main body comprises a bottom plate, two side plates, and two shielding plates; the two side plates are perpendicularly positioned on two opposite sides of the bottom plate, the two shielding plates are perpendicularly positioned on another two opposite sides of the bottom plate and connected between the two side plates; the receiving room is defined by the bottom plate, the two side plates, and the two shielding plates, each of the two shielding plates defines a notch communicating with the receiving room.

8. The drum coating device of claim 7, wherein the heating device comprises a circuit board and a plurality of heating elements electrically connected with the circuit board, the circuit board is bridged between two sides of the notch of one shielding plate, and the heating elements face the receiving room.

9. The drum coating device of claim 7, wherein the rotary drum device comprises a number of rollers, a number of rolling drivers, and two first support strips; the two first support strips are oppositely positioned on the two shielding plates and adjacent to the top of the main body, the rollers are equidistantly spaced from each other and rotatably bridge the two first support strips, the rolling drivers are secured to the first support strips and coupled with the rollers.

10. The drum coating device of claim 9, wherein a distance between each two adjacent rollers is substantially equal to or slightly larger a thickness of each work-piece.

11. The drum coating device of claim 7, wherein the bottom plate defines a through hole in the center thereof, each of the side plates comprises an upper surface and a side surface.

12. The drum coating device of claim 11, wherein the spraying device comprises a number of spraying nozzles and a second support strip, the second support strip bridges the two upper surfaces of the two side plates.

13. The drum coating device of claim 11, wherein the cleaning device comprises two cleaning nozzles oppositely positioned on the middles of the two side surfaces of the two side plates.

* * * * *